US010832565B2

(12) United States Patent
Pirkle et al.

(10) Patent No.: US 10,832,565 B2
(45) Date of Patent: Nov. 10, 2020

(54) SYSTEM AND METHOD FOR ACOUSTICALLY IDENTIFYING GUNSHOTS FIRED INDOORS

(71) Applicant: Tyco Fire & Security GmbH, Neuhausen am Rheinfall (CH)

(72) Inventors: Wesley C. Pirkle, New Albany, OH (US); Richard L. Shoaf, Westerville, OH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 16/328,070

(22) PCT Filed: Aug. 15, 2017

(86) PCT No.: PCT/US2017/046940

§ 371 (c)(1),
(2) Date: Feb. 25, 2019

(87) PCT Pub. No.: WO2018/044553

PCT Pub. Date: Mar. 8, 2018

(65) Prior Publication Data

US 2019/0180606 A1 Jun. 13, 2019

Related U.S. Application Data

(60) Provisional application No. 62/380,701, filed on Aug. 29, 2016.

(51) Int. Cl.
*G08B 29/18* (2006.01)
*G08B 17/08* (2006.01)
(Continued)

(52) U.S. Cl.
CPC ..... *G08B 29/185* (2013.01); *G08B 13/1672* (2013.01); *G08B 17/08* (2013.01);
(Continued)

(58) Field of Classification Search
None
See application file for complete search history.

(56) References Cited

U.S. PATENT DOCUMENTS 4,091,366 A * 5/1978 Lavallee ..... G08B 25/10 340/524
4,279,027 A * 7/1981 Van Sloun ..... G01S 11/14 340/943

(Continued)

OTHER PUBLICATIONS

International Search Report and Written Opinion, dated Nov. 7, 2017, from International Application No. PCT/US2017/046940, filed on Aug. 15, 2017. 15 pages.

(Continued)

*Primary Examiner* — Chico A Foxx
(74) *Attorney, Agent, or Firm* — HoustonHogle LLP

(57) ABSTRACT

A system and method for acoustically detecting the firing of gunshots indoors employs multiple microphones (15, 20) which are utilized individually and in combination to detect sounds inside a building or other structure and, upon sensing a loud impulsive sound which is indicative of a gunshot, processing signals from both microphones (15, 20) to determine if the sound is that of a gunshot. The system and method relies on the acoustic signature of the noise as collected, with the acoustic signature being analyzed to arrive at values which are then compared to adjustable levels that signify a gunshot.

23 Claims, 2 Drawing Sheets

(51) Int. Cl.

| | |
|---|---|
| ***G10L 25/51*** | (2013.01) |
| ***H04R 1/40*** | (2006.01) |
| ***H04R 3/00*** | (2006.01) |
| ***G08B 13/16*** | (2006.01) |

(52) U.S. Cl.
CPC ..... *G10L 25/51* (2013.01); *H04R 1/406* (2013.01); *H04R 3/005* (2013.01)

(56) References Cited

U.S. PATENT DOCUMENTS 5,237,512 A * 8/1993 Davidson ..... G08B 17/12 340/578
5,455,868 A 10/1995 Sergent
5,504,717 A * 4/1996 Sharkey ..... G01S 3/808 367/124
5,917,775 A 6/1999 Salisbury
6,185,153 B1 2/2001 Hynes et al.
6,538,570 B1 3/2003 Smith
8,421,015 B1 * 4/2013 Scott ..... F41G 3/147 250/338.4
9,830,932 B1 * 11/2017 Gunderson ..... G10L 25/51
10,210,726 B2 * 2/2019 Carter ..... G08B 17/00
2003/0021188 A1 * 1/2003 Baranek ..... G08B 7/066 367/136
2004/0161120 A1 * 8/2004 Petersen ..... H04R 3/005 381/92
2006/0256660 A1 * 11/2006 Berger ..... G01S 5/20 367/124
2009/0059724 A1 * 3/2009 Scanlon ..... G01S 3/801 367/118
2009/0180628 A1 7/2009 Stephanson
2011/0218952 A1 * 9/2011 Mitchell ..... G10L 15/02 706/12
2011/0246402 A1 * 10/2011 Burman ..... G08B 13/1672 706/14
2012/0300587 A1 * 11/2012 Azimi-Sadjadi ..... G01S 11/14 367/127
2014/0327543 A1 * 11/2014 Showen ..... G08B 17/08 340/540
2014/0361886 A1 * 12/2014 Cowdry ..... G08B 13/1672 340/522
2015/0070166 A1 * 3/2015 Boyden ..... G08B 25/08 340/540
2015/0071450 A1 * 3/2015 Boyden ..... H04R 27/00 381/58
2015/0106095 A1 * 4/2015 Mitchell ..... G10L 25/51 704/236
2015/0131411 A1 5/2015 Gudgel et al.
2015/0347079 A1 * 12/2015 Price ..... H04R 3/005 700/94
2015/0364028 A1 * 12/2015 Child ..... G08B 1/08 348/143
2016/0157032 A1 * 6/2016 Kane ..... H04R 3/00 381/56
2016/0209390 A1 * 7/2016 Overcast ..... G01N 33/227
2016/0232774 A1 * 8/2016 Noland ..... G08B 13/1672
2016/0260307 A1 * 9/2016 Skorpik ..... G08B 21/02
2016/0334500 A1 * 11/2016 Damarla ..... H04R 3/005
2017/0103776 A1 * 4/2017 Kim ..... G10L 25/51
2017/0123038 A1 * 5/2017 Griggs ..... G08B 13/1672
2017/0169686 A1 * 6/2017 Skorpik ..... G08B 21/02
2018/0293858 A1 * 10/2018 Carter ..... G08B 17/00
2019/0347920 A1 * 11/2019 Anderson ..... G10L 25/51
2019/0371160 A1 * 12/2019 Pace ..... G08B 13/1672

OTHER PUBLICATIONS

Tolonen, T., et al., "A Computationally Efficient Multipitch Analysis Model," IEEE Transations on Speech and Audio Processing, 8(6): 708-716 (2000).
International Preliminary Report on Patentability, dated Mar. 14, 2019, from International Application No. PCT/US2017/046940, filed on Aug. 15, 2017. 9 pages.

* cited by examiner

SYSTEM AND METHOD FOR ACOUSTICALLY IDENTIFYING GUNSHOTS FIRED INDOORS

RELATED APPLICATIONS

This application is a § 371 National Phase Application of International Application No. PCT/US2017/046940, filed on Aug. 15, 2017, now International Publication No. WO 2018/044553, published on Mar. 8, 2018, which International Application claims the benefit under 35 USC 119(e) of U.S. Provisional Application No. 62/380,701, filed on Aug. 29, 2016, both of which are incorporated herein by reference in their entirety.

BACKGROUND OF THE INVENTION

Field of the Invention

The present invention pertains to the art of acoustics and, more particularly, to a system and method employing acoustics in connection with identifying the firing of gunshots indoors.

Discussion of the Prior Art

The broad concept of detecting gunshots utilizing acoustics is known. More specifically, it is known to provide a gunshot detecting system including an array of acoustic sensors positioned in a pattern which enables signals from the sensors to be employed to not only detect the firing of a gunshot but to also locate the origin of the shot. One main requirement of such a system is the need to accurately distinguish between the sound produced from a gunshot and a host of other ambient sounds. In at least one known arrangement, a microphone is used to detect each sound, which is then amplified, converted to an electrical signal and then the electrical signal is compared with a threshold value above which a gunshot sound is expected to exceed.

Regardless of the known arrangements in this field, there is still seen to exist a need for a system and method for acoustically detecting the firing of gunshots indoors which represents an improvement in terms of at least one or more of accuracy, dependability and effectiveness, particularly an acoustic gunshot detection system and method which provides for very low false alarms or false positives while, at the same time, provides for high detection rates.

SUMMARY OF THE INVENTION

The present invention is directed to a system and method for acoustically detecting the firing of gunshots indoors wherein multiple microphones are utilized individually and in combination to detect sounds inside a building or other structure and, upon sensing a loud impulsive sound, processing is performed to determine if the sound is that of a gunshot. The system and method relies on the acoustic signature of the noise as collected, with the acoustic signature being analyzed to arrive at values which are then compared to adjustable levels that signify a gunshot. If it is determined that a gun has been fired, the system can issue alerts, including notifying emergency personnel.

In a particular embodiment, two MEMs microphones (microelectromechanical microphones) having different sensitivity levels are employed for each sensor. The microphones are omnidirectional, with one microphone having a low sensitivity and a high clipping level, while the other microphone is more sensitive. Within the overall sensor, the two microphones are arranged orthogonal to each other. The sensor preferably includes a single board computer which is configured to sample the multiple MEMs microphones, such that the outputs from the microphones can be continuously analyzed in near real time for a gunshot signature. The sensor is electrically powered and networkable, thereby enabling output signals to be transferred remotely, either for additional processing or other purposes such as alerting emergency personnel of a shooting at a specific location in a particular building.

In accordance with a preferred embodiment of operation, the initial gunshot identification is accomplished by analyzing incoming acoustic signals from the lower sensitivity microphone, particularly by searching the incoming acoustic signal for a peak amplitude level large enough to be at least preliminarily identified as a gunshot. Once an indication of a possible gunshot has been triggered utilizing the lower sensitivity microphone, the sensed impulsive sound is processed. In particular, a series of calculations are performed, with the results of these calculations are compared with established threshold values and, if the comparisons are positive, a gunshot verification is established. Upon gunshot verification, a threat message is preferably produced which can be sent from the sensor to another computer used to alert emergency personnel. The threshold levels can be selectively adjusted and set based on the acoustics of the building or other structure, as well as the sensor layout employed.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
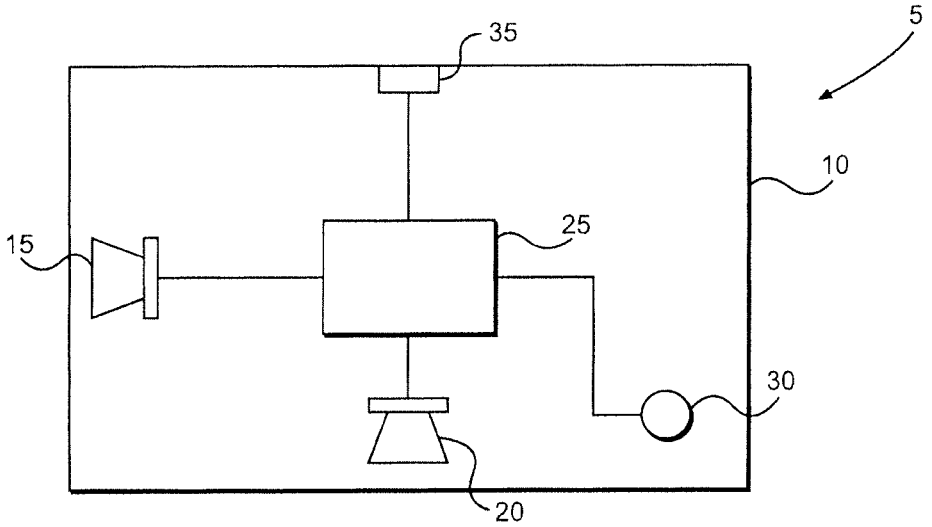
FIG. 1 schematically indicates structure associated with the sensor of the invention.

With initial reference to FIG. 1, a gunshot detection sensor designed for mounting within a building or structure to be monitored for gunshots in accordance with the invention is generally indicated at 5. In the embodiment shown, sensor 5 includes a single computer board 10 linked to a first microphone 15 and a second microphone 20. As depicted, first and second microphones 15 and 20 are preferably arranged orthogonal to each other and connected to a CPU 25 (particularly a multi-core processor for fast signal processing) which is electrically powered, such as through a 5V battery 30, a micro USB port or the like. Also provided as part of sensor 5 is a network connector, such as an Ethernet, USB or the like connection port indicated at 35. At this point, it should be noted that sensor 5 can actually take on various forms while functioning and operating in the manner which will be detailed below. Certainly, it should be recognized that sensor 5 could be electrically powered in various ways, including being electrically hardwired, and need not be network hardwired but rather can incorporate a wireless interface. In general, it is important that CPU 25 is capable of sampling acoustic signals received from both microphones 15 and 20, specifically at a minimum of 192 KHz.

In the most preferred form of the invention, each microphone 15, 20 constitutes a MEMs microphone which is omnidirectional. In accordance with the invention, one microphone 15 has a low sensitivity while the other microphone 20 is more sensitive. In accordance with the invention, a low sensitivity is defined as below −40 dBFS while, by "more sensitive" it is meant that microphone 20 has a sensitivity which is at least 70% greater than the sensitivity of the "low sensitivity" microphone 15. In an exemplary embodiment, microphone 15 has a low sensitivity of −46 dBFS, but with a high clipping level, specifically greater than 130 dB. On the other hand, microphone 20 has a sensitivity of −26 dBFS. Although various known microphones could be employed in connection with the invention, in one specific embodiment, currently available MEMs microphone models INMP621ACEZ-R7 and MP34DBO1TR which are digital, 16 bit microphones manufactured by InvenSense, Inc. are utilized for the first and second microphones 15 and 20 respectively.

In general, the system and method operates by initially identifying an incoming acoustic signal which could potentially be from a gunshot. For this purpose, only outputs from microphone 15 are initially, continuously analyzed for a peak amplitude level large enough to be preliminarily identified as a gunshot. Basically, since microphone 15 has a low sensitivity, microphone 15 only provides an output for very loud sounds and is essentially deaf to normal, everyday sounds emanating from within the building or structure and therefore will likely not reach a necessary threshold on any noise other than the loudest sounds. By way of example, a typical trigger value would be −5 dBFS (corresponding to a digital value of approximately 18000 based on the 16 bit unit). After a possible gunshot is identified in this manner, the system then processes acoustic signals to determine if the sound was actually from a gunshot in the manner detailed below.

Figure 2:
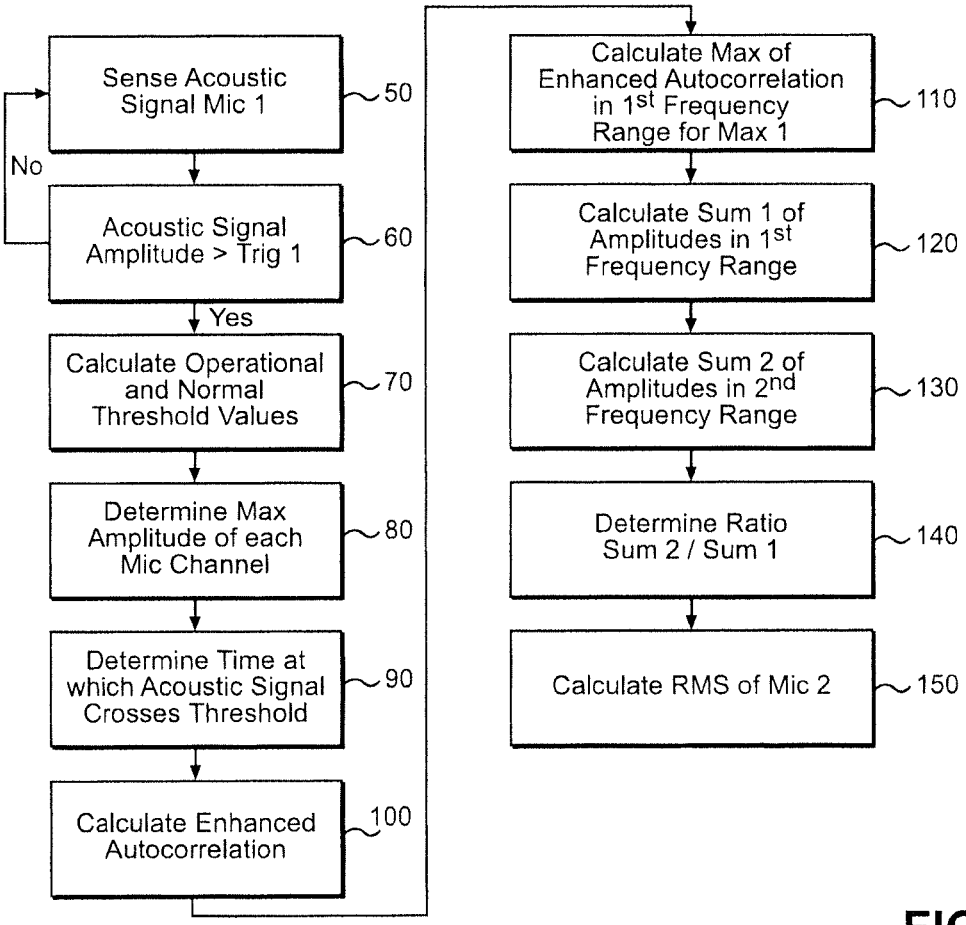
FIG. 2 is a flowchart of a calculation algorithm employed in accordance with the invention.

Reference will now be made to FIG. 2 in describing a preferred methodology employed in accordance with the invention. Here, it can be seen that steps 50 and 60 represent the initial possible gunshot identification routine outlined above which utilizes outputs from first microphone 15 and compares peak signal amplitudes with a pre-established trigger value, e.g., 18000. Assuming that a possible gunshot sound has been identified, step 70 is reached in which operational and nominal threshold values are established for upcoming calculations. At this point, it should be noted that these threshold values can actually be preset based on at least the acoustic characteristics of the particular building or structure in which sensor 5 is employed. However, for at least versatility reasons, it is desirable to enable these threshold values to be adjustable, such as based on changing acoustic characteristics or sensor layout. In addition to the trigger threshold, other established threshold values include: a Mic1 threshold (TH_1), a Mic2 RMS threshold (RMS_2_Thresh), a time window (Win_1), an enhanced autocorrelation window (EnAuto_Win_1), an enhanced autocorrelation threshold for an established frequency range between 15 kHz and 25 kHz (EnAuto_15_25_Thresh_1) and a maximum enhanced autocorrelation threshold for the established frequency range (EA_Max_15_25_TH). By way of example, the following nominal threshold values can be employed: Trig_1=18000; TH_1=5000; RMS_2_Thresh=−13 dBFS (or an equivalent digital output of 7336); Win_1=0.30 seconds; EnAuto_Win_1=0.075 seconds; EnAuto_15_25 Thresh_1=1.25; and EA_Max_15_25_TH=325.

With these nominal threshold values being established, step 80 is entered wherein the maximum amplitude for each of microphones 15 and 20 is determined (Max_1 and Max_2). Next, the time at which the acoustic signal crosses the threshold is determined in step 90. Basically, there is a time lapse between first microphone 15 sensing the sound and outputting the signal which has been identified as a potential gunshot. Here, it is desired to determine time zero (T_Win_1) for the potential shot and use this time for future calculations. Although other formulations could be employed, for purposes of a preferred embodiment of the invention, T_Win_1 is set equal to the time at which the first microphone amplitude exceeds TH_1 minus a predetermined time period, preferably 10 ms, wherein T_Win_1 is required to be less than Win_1, i.e., 0.3 seconds, from the point at which the amplitude is greater than Trig_1. This same calculated time zero is also used in connection with second microphone 20 (T_Win_2=T_Win_1).

Next, step 100 is entered wherein an enhanced autocorrelation is calculated. At this point, it should be recognized that enhanced autocorrelation is known based on harmonics. Here, a known method is employed to filter data by determining pitches based on frequencies. As enhanced autocorrelation methods are known, further details will not be provided here. By way of example, reference is simply made to the article "A Computationally Efficient Multipitch Analysis Model" by Tolonen et al., IEEE Transactions on Speech and Audio Processing, Vol. 8, No. 6, (November 2000), the contents of which are fully incorporated herein by reference. With the invention, the preset operational enhanced correlation window (EnAuto_Win_1) is employed.

In step 110, a maximum value of the enhanced auto correlation is determined. For this purpose, values in a first frequency range or band between 15 kHz and 25 kHz are relied upon for microphone 15. Here, the process is looking to establish a peak in this frequency range (EA_Max_15_25_1). Next, all amplitudes in a slightly larger, second frequency range, preferably 10 kHz to 25 kHz, are summed in step 120 (EA_10_25_Sum_1). Thereafter, all amplitudes in a third, distinct frequency range, preferably frequency bands between 2 kHz to 5.5 kHz, are summed in step 130 (EA_2_55_Sum_1). These two summation steps in distinct ranges are performed in connection with avoiding a false positive identification based on knowing that sounds from a gunshot have a broad range as compared to many other potentially sensed sounds.

With all the above calculations, the algorithm moves to step 140 wherein a ratio of the summation values determined in steps 130 and 120 is determined, i.e., Ratio_EA_1=EA_2_55_Sum_1/EA_10_25_Sum_1. In this step, the denominator cannot equal zero. Therefore, if EA_10_25_Sum_1 equals zero, the Ratio_ EA_ 1 is set to a predetermined value, such as 3.0. Finally, in step 150, the RMS of microphone 20 is calculated. More specifically, the RMS of microphone 20 (RMS_Full_2) is calculated using Win_1 and starting at T_Win_2. Basically, these steps are performed to see how the sound dissipates over a relatively short period of time, say 0.3 seconds, for microphone 20. Here it should be noted that the sound associated with a gunshot takes a fair amount of time to dissipate versus, say, tapping a microphone. Therefore, it can be verified here that the RMS stays high for a requisite period of time. Additionally, it should be recognized that signals from microphone 20 can be used for further verification, e.g., sensing sounds of screaming versus laughter or minor chatter.

Figure 3:
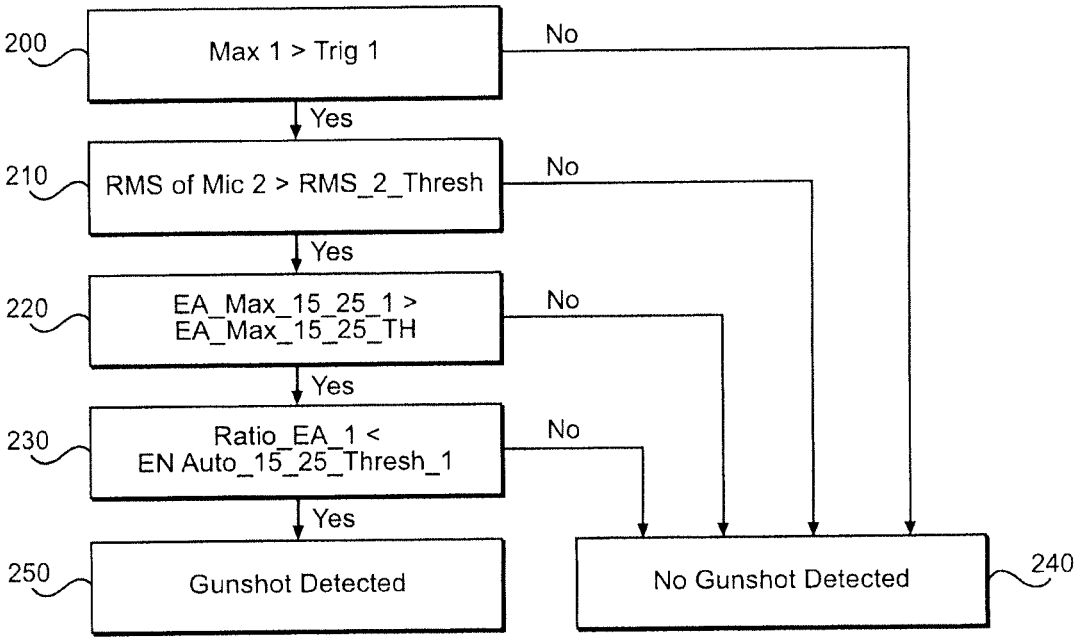
FIG. 3 is a flowchart of a comparing algorithm employed in accordance with the invention.

Once the calculations associated with the FIG. 2 algorithm are performed, it can then be determined if the detected sounds were actually from a gunshot. In accordance with a preferred embodiment of the invention as represented in FIG. 3, it is only determined that a gunshot has been detected if multiple requirements are satisfied, i.e., each of the requirements of steps 200, 210, 220 and 230 are satisfied. Specifically, to move past step 200, it must be determined that the maximum amplitude sensed by microphone 15 is greater than the trigger value (Max_1>Trig_1). Of course, this is just a verification step based on the requirements of step 60. In addition, RMS_Full_2>RMS_2_Thresh (step 210), EA_Max_15_25_1>EA_Max_15_25_TH (step 220), and Ratio_EA_1<EnAuto_15_25_Thresh_1 (step 230). If any one of these determinations cannot be made, it is determined that a gunshot has not been detected (step 240). On the other hand, if all of these verification steps are satisfied, step 250 is reached to verify that an actual gunshot has been sensed. If a gunshot is detected at 250, this is signaled via port 35 to a networked computer that can be used for alert purposes, such as alerting emergency personnel, such as building or local jurisdictional personnel) of the occurrence of the gunshot and, based on the particular sensor used in making the determination, the location of the gunshot.

Although described with reference to preferred embodiments of the invention, it should be readily understood that various changes and/or modifications can be made to the invention without departing from the spirit thereof. Overall, it has been found that employing two microphones with low and high sensitivities and making a detection decision based on at least certain threshold, root-mean-square (RMS), time window, and auto correlation frequency values, provides for very low false alarms or false positives while, at the same time, provides for high detection rates. In any event, the invention is only intended to be limited by the scope of the following claims.

The invention claimed is:

1. A method of acoustically detecting a gunshot with a sensor that comprises a first microphone having a low sensitivity, a second microphone being more sensitive than the first microphone, a processor and a computer board, the method comprising the steps of:

a) identifying, with the first microphone, when an incoming acoustic signal has a peak amplitude level greater than a trigger threshold established for a potential gunshot;

b) if the potential gunshot is identified in step a), analyzing signals sensed by the first microphone in multiple, distinct frequency ranges to avoid false positive identification of gunshot occurrences;

c) comparing, in response to the potential gunshot being identified, a value calculated based on signals from a second microphone corresponding to the potential gunshot with a threshold value used to determine gunshot occurrences; and d) determining that an occurrence of a gunshot has been detected based on results from both steps b) and c) to verify the occurrence of the gunshot;

wherein the first microphone and the second microphone both are electrically connected to the processor and arranged orthogonal to one another on the computer board.

2. The method of claim 1, further comprising: establishing a maximum amplitude for each of the first and second microphones.

3. The method of claim 1, further comprising: determining a time for the potential gunshot which is prior to a time when the incoming acoustic signal is sensed with the first microphone.

4. The method of claim 3, further comprising: basing the time for the potential gunshot based on amplitudes of signals from the first microphone at multiple, different times.

5. The method of claim 1, further comprising: performing enhanced autocorrelation on signals from the first microphone.

6. The method of claim 5, further comprising: calculating a maximum of the enhanced autocorrelation within a defined frequency range.

7. The method of claim 6, wherein the defined frequency range is between 15 kHz and 25 kHz.

8. The method of claim 1, wherein analyzing signals sensed by the first microphone in multiple, distinct frequency ranges includes calculating a sum of amplitudes in a first frequency range.

9. The method of claim 8, wherein the first frequency range is from 10 kHz to 25 kHz.

10. The method of claim 8, wherein analyzing signals sensed by the first microphone in multiple, distinct frequency ranges further includes calculating a sum of amplitudes in a second frequency range which is lower than the first frequency range.

11. The method of claim 10, wherein the second frequency range is from 2 kHz to 5.5 kHz.

12. The method of claim 11, wherein analyzing signals sensed by the first microphone in multiple, distinct frequency ranges further includes calculating a ratio of the sum of amplitudes in the first and second frequency ranges.

13. The method of claim 1, wherein comparing a value calculated based on signals from a second microphone includes determining a root-mean-square value of signals from the second microphone over a predetermined time period and comparing the root-mean-square value with the threshold value.

14. The method of claim 1, wherein the method is limited to determining the occurrence of a gunshot within a building or other structure.

15. A method of acoustically detecting a gunshot comprising the steps of:

a) identifying when an incoming acoustic signal sensed with a first microphone, having a low sensitivity, has a peak amplitude level greater than a trigger threshold established for a potential gunshot;

b) if a potential gunshot is identified in step a), analyzing signals sensed by the first microphone in multiple, distinct frequency ranges;

c) comparing a value calculated based on signals from a second microphone, which is more sensitive than the first microphone, with a threshold value; and d) determining that an occurrence of a gunshot has been detected based on results from both steps b) and c), wherein the method is limited to determining the occurrence of a gunshot within a building or other structure and further comprises establishing operational and nominal threshold values for the method, wherein determining that an occurrence of a gunshot has been detected requires, in addition to requirements of steps a) and c), a determination that additional requirements of at least two comparisons between values calculated based on signals from the first microphone and the operational and nominal threshold values have been met.

16. The method of claim 15, further comprising: adjusting the operational and nominal threshold values based on at least acoustic parameters of the building or other structure.

17. The method of claim 1, further comprising: alerting emergency personnel when the occurrence of a gunshot has been detected.

18. A system for acoustically detecting a gunshot within a building or other structure comprising:

a sensor including a first microphone having a low sensitivity and a second microphone which is more sensitive than the first microphone; and a controller configured to determine an occurrence of a gunshot within the building or other structure based on signals received from each of the first and second microphones, wherein the controller determines the occurrence of the gunshot by performing the steps of:

a) identifying, with the first microphone, when an incoming acoustic signal has a peak amplitude level greater than a trigger threshold established for a potential gunshot;

b) if the potential gunshot is identified in step a), analyzing signals sensed by the first microphone in multiple, distinct frequency ranges to avoid false positive identification of gunshot occurrences;

c) comparing, in response to the potential gunshot being identified, a value calculated based on signals from the second microphone corresponding to the potential gunshot with a threshold value used to determine gunshot occurrences; and d) determining that an occurrence of a gunshot has been detected based on results from both steps b) and c) to verify the occurrence of the gunshot;

wherein the first microphone and the second microphone both are electrically connected to a processor and arranged orthogonal to one another on a computer board.

19. The system of claim 18, wherein the sensor further includes a network port configured to connect the sensor to a remote computer.

20. The system of claim 18, wherein the first and second microphones are arranged orthogonal to one another.

21. The method of claim 1, wherein the first microphone has a sensitivity of below −40 dBFS.

22. The method of claim 1, wherein the second microphone has a sensitivity that is at least 70% greater than the sensitivity of the first microphone.

23. The method of claim 1, wherein only outputs from the first microphone are initially, continuously analyzed for a peak amplitude level greater than the trigger threshold.

* * * * *